US005249521A

United States Patent [19]

Kobler

[11] Patent Number: 5,249,521

[45] Date of Patent: Oct. 5, 1993

[54] DEVICE FOR CHANGING OVER TO SINGLE-SIDE PRINTING OR PERFECTING ON SHEET-FED ROTARY PRINTING MACHINES

[75] Inventor: Ingo Kobler, Anhausen, Fed. Rep. of Germany

[73] Assignee: MAN Roland Druckmaschinen AG, Fed. Rep. of Germany

[21] Appl. No.: 952,293

[22] Filed: Sep. 28, 1992

[30] Foreign Application Priority Data

Sep. 27, 1991 [DE] Fed. Rep. of Germany ..... 4132250

[51] Int. Cl.[5] ..... B41F 21/00; B41F 13/12

[52] U.S. Cl. ..... 101/230

[58] Field of Search ..... 101/229, 230, 231, 232, 101/183, 184, 409, 222, 216; 271/902, 225

[56] References Cited

U.S. PATENT DOCUMENTS 4,122,773 10/1978 Wirz ..... 101/230
4,147,105 4/1979 Becker ..... 101/231

FOREIGN PATENT DOCUMENTS 1056573 5/1959 Fed. Rep. of Germany .
1411775 2/1973 Fed. Rep. of Germany .
135812 5/1979 Fed. Rep. of Germany .
3136349 8/1982 Fed. Rep. of Germany .
8319431 2/1984 Fed. Rep. of Germany .

*Primary Examiner*—J. Reed Fisher
*Attorney, Agent, or Firm*—Leydig, Voit & Mayer

[57] ABSTRACT

The invention relates to a device for changing over to single-side printing or perfecting on sheet-fed rotary printing machines. Two respective pairs of intermediate spur wheels are disposed between the printing cylinder spur wheel and the turning drum spur wheel, a first pair of the intermediate spur wheels being in the form of a double wheel. The second pair of intermediate spur wheels are secured to a solid shaft or hollow shaft, preferably received in a control means for selectively driving the solid and hollow shaft in unison or differentially to one another. In another embodiment a set of intermediate wheels includes spur wheels associated with first and second printing cylinders. Intermediate spur wheels are disposed between the printing cylinder spur wheels and an annular wheel coupled to the turning drum. The intermediate spur wheels are likewise secured to a solid shaft or hollow shaft received in the control means for selectively driving the solid and hollow shaft in unison or differentially to one another.

7 Claims, 3 Drawing Sheets

DEVICE FOR CHANGING OVER TO SINGLE-SIDE PRINTING OR PERFECTING ON SHEET-FED ROTARY PRINTING MACHINES

BACKGROUND OF THE INVENTION

1. Field of the Invention

The present invention relates generally to rotary printing machines, and more particularly to a device for changing between single-side printing and perfecting printing in sheet-fed rotary printing machines.

2. Description of the Prior Art

The invention relates to a device whereby turning drums and press cylinders disposed between the individual printing units of a series-construction sheet-fed rotary printing machine can be changed over as required between a single-side printing configuration or a perfecting configuration.

In change-over type single-side printing or perfecting printing machines, the sheets are engaged by the printing cylinder via suckers or grippers disposed on the turning drum. These suckers or grippers suck or grip the front edge or rear edge of the sheets. In order to change the machine over from single-side printing to perfecting, and in order to adjust to different formats, it is necessary to make a phase shift between the printing cylinders and the turning drums.

DE Utility Model 8 319 431 discloses a device for changing over to single-side printing or perfecting as required. This device is characterized in that a clampable double wheel in a toothed wheel/toothed rim configuration is disposed on the turning drum and the required switching and clamping operations are carried out by hydraulic or mechanically actuated devices.

DE-OS 3 136 349 discloses a method of adjusting the drive, based on DD-WP 135 812. A double gearwheel is disposed on the printing cylinder trunnion. The first gearwheel is permanently connected to the trunnion, whereas the second gearwheel, which is a toothed rim, is clamped or released by spring force and a friction lining disposed on the flat side surface of a ring. The ring is toothed in addition to the first gearwheel. Adjusting members for hydraulically clamping or releasing the connection are disposed on the ring which transmits the contact pressure.

The required changeover to single side printing or perfecting, as represented by these devices is relatively expensive to achieve, which is a disadvantage. The hydraulic clamping devices are expensive and have to be located separately from the gear systems.

DE-AS 1,056,573 also discloses a drive arrangement with a central wheel. For each printing cylinder, there is a gear coupled to the central wheel. By means of intermediate planetary gear wheels there is brought about a translation into a slower rate. However, this solution cannot be arranged in a closed gear train and does not permit separate drive of individual turning drums. It is unsuited, therefore, for the changing over to single-side printing or perfecting printing.

In the roll machine building art there is also known an arrangement for length-register regulation. Thus, as shown in DE-AS 1,411,775, the drive of a form cylinder occurs from the main drive shaft over two gear wheels, a differential gear and its off-drive shaft. A servomotor controls the differential gear in such manner that the form cylinder is accelerated or retarded for the length-register adjustment. However, this solution cannot be arranged in a closed gear train in order to bring about a changing over to single-side printing or perfecting printing.

OBJECTS AND SUMMARY OF THE INVENTION

Accordingly, it is a primary aim of the present invention to provide a device for changing over to single-side printing or perfecting printing, the device using not more than two gearwheel planes and only a single drum and being adapted to make a number of successive turns and eliminating subjective errors by the operator.

A further aim is to provide a device in which the same printing cylinder wheels can be used for single-side printing or perfecting printing.

In the preferred embodiment of the invention, a hollow shaft and a solid shaft are connected by a clamping device, in order to reinforce the set of wheels during printing and to reduce possible clearance between the gear teeth. More specifically, the connection between the shafts is released in order to phase-shift the turning drum.

The device according to the present invention has short change-over times even when a number of turns follow in succession. No double-width printing cylinder gearwheels are required. Consequently printing cylinder gearwheels having a uniform width and lying in a single plane can be used in all units of single-side printing or perfecting machines.

These and other features and advantages of the invention will be more readily apparent upon reading the following description of a preferred exemplified embodiment of the invention and upon reference to the accompanying drawings, wherein:

While the invention will be described and disclosed in connection with certain preferred embodiments and procedures, it is not intended to limit the invention to these specific embodiments. Rather, it is intended to cover all such alternative embodiments and modifications as they fall within the spirit and scope of the invention.

DESCRIPTION OF THE PREFERRED EMBODIMENT

Figure 1:
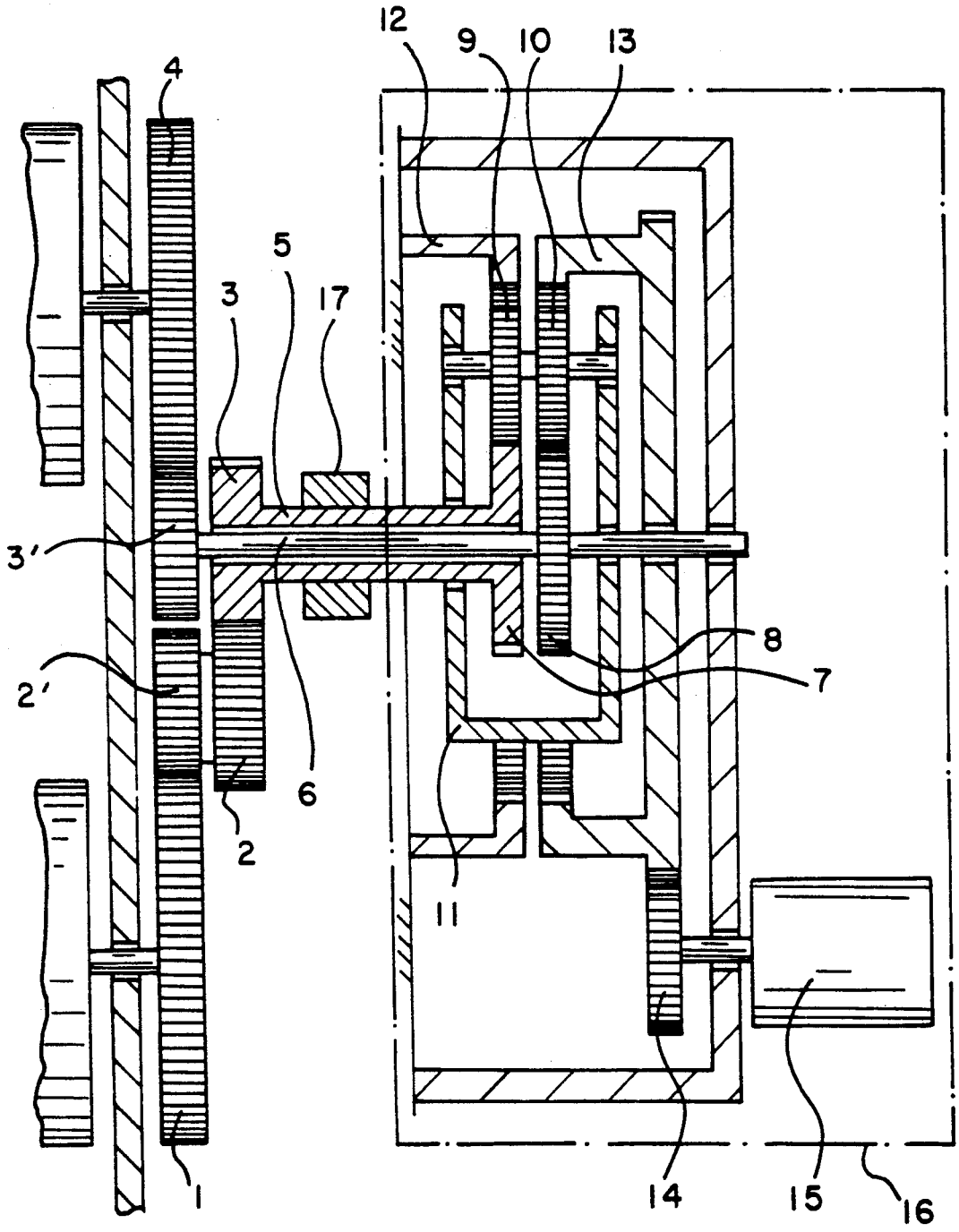
FIG. 1 is a sectional view of the changing device according to a first embodiment of the invention.

FIG. 1 shows one exemplary embodiment of a phase changing device for a sheet-fed printing press according to the invention. Two pairs of intermediate spur wheels 2, 2' and 3, 3' are disposed between a spur wheel 4 of the turning drum and a printing cylinder spur wheel 1'. The first pair of intermediate spur wheels 2, 2', associated with the mating cylinder spur wheel 1', are in the form of a double wheel. The first spur wheel 2' is in engagement with the spur wheel 1'. The second spur wheel 2 engages the third spur wheel 3, which is disposed on a hollow shaft 5 and the hollow shaft 5 is received in a control means 16, to be described hereinafter.

The second pair of intermediate spur wheels 3, 3' is secured coaxially. The fourth spur wheel 3' is secured on a solid shaft 6 and the third intermediate spur wheel 3 is disposed on the hollow shaft 5. The shafts 5 and 6 are received in the control means 16 described below. The solid shaft 6 and the hollow shaft 5 thus provide the connection between the third and fourth spur wheels 3, 3' and the control means 16. The fourth spur wheel 3' also engages the spur wheel 4 of the turning drum. In keeping with one aspect of the invention, the first and fourth spur wheels 2' and 3' have a smaller radius than the second and third spur wheels 2 and 3. All four spur wheels 2, 2', 3 and 3' have the same number of teeth. As a result, the teeth on the first and fourth spur wheels 2' and 3' are not in contact, i.e., are out of engagement.

The control means 16 selectively drives the solid and hollow shafts in unison or differentially with respect to one another. A first sun wheel 7 is disposed coaxially with a second sun wheel 8. The second sun wheel 8 is fixed to the solid shaft 6. The first sun wheel 7 is fixed to the hollow shaft 5. A rotatable web 11 supported on the shafts 5 and 6 carries first and second planetary wheels 9 and 10, which are disposed parallel to one another and are journalled for rotation on the web 11. Also provided are first and second internally toothed annular wheels 12 and 13. The first annular wheel 12 is fixed to the housing, while the second annular wheel 13 is carried on and rotatable with respect to the solid shaft 6. Further, the second annular wheel 13 has an outside toothed rim. The first planetary wheel 9 is disposed between the first sun wheel 7 and the first annular wheel 12. Similarly, the second planetary wheel 10 is disposed between the second sun wheel 8 and the second annular wheel 13. A positioning and braking means 15 including a pinion 14 engages the outside-toothed rim of the second annular wheel 13. The positioning and braking means 15 is actuated for selectively rotating and stopping the second annular wheel.

During printing operation, a clamping means 17 transfers the driving force from the turning drum to the printing cylinder. The transfer is initiated via the spur wheel 4 of the turning drum and the fourth spur wheel 3' in engagement therewith, and transmitted via the solid shaft 6 to the second sun wheel 8 and the second planetary wheel 10 in engagement. The second planetary wheel 10 rolls on the inner teeth of the second annular wheel 13 in conjunction with the first planetary wheel 9 disposed on the rotatable web 11 and paired with the first, fixed annular wheel 12. The second annular wheel 13, via its outwardly-toothed rim, is engaged with the pinion 14 and secured by the positioning and braking means 15. The power take-off of the spur wheel 1' of the printing cylinder is via the first planet wheel 9, first sun wheel 7 and hollow shaft 5 and via the spur wheels 3, 2, 2'. In order to reinforce the set of wheels during printing, and to reduce possible clearance between teeth, the hollow shaft 5 and solid shaft 6 are connected by a clamping means 17. This connection between shafts is released during the phase shift of the turning drum.

The required phase shift of the turning drum is made by switching off the drive and actuating the positioning and braking means 15. The turning motion of the spur wheel 4 of the turning drum is initiated by the pinion 14 engaging the externally toothed rim of the second annular wheel 13. The internal teeth on the second annular wheel 13 engage the second planetary wheel 10, which in turn engages the second sun wheel 8, solid shaft 6 and fourth spur wheel 3'. After the phase shift, the positioning and braking means 15 is switched off and the drive continues via the spur wheel 4.

Towards the next machine unit (power take-off) the set of wheel is closed by the intermediate spur wheels, which have a single width (not shown in FIG. 1) and are disposed downstream of the spur wheel 1' of the printing cylinder, and is also closed by the spur wheel of the next-following drum.

Figure 2:
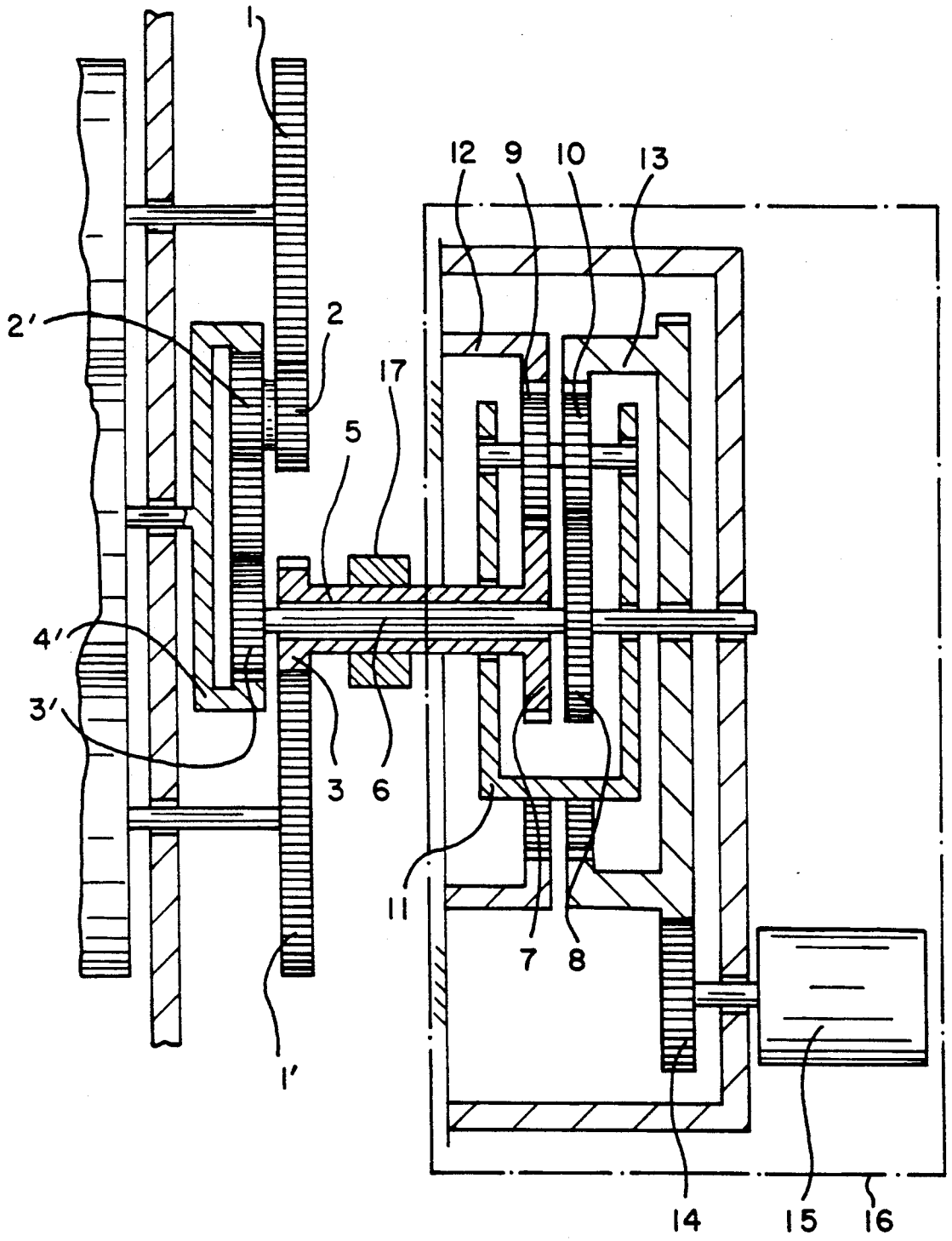
FIG. 2 is a sectional view of the changing device according to a second embodiment of the invention.

A second exemplary embodiment is shown in FIG. 2. Between the first and second printing cylinder spur wheels 1, 1', a set of wheels is formed by the intermediate spur wheels 2, 2', 3, 3' and an annular wheel with internal teeth 4' of the turning drum. The first pair of intermediate spur wheels 2, 2' associated with the first printing cylinder spur wheel 1 are in the form of a double wheel, the first spur wheel 2' being paired with the first printing cylinder spur wheel 1 and the second spur wheel 2 being paired with the annular wheel 4'. The annular wheel 4' of the turning drum is in engagement with the fourth spur wheel 3' mounted on the solid shaft 6. The solid shaft 6, as in the first example, is mounted in a hollow shaft 5 and both shafts 5, 6 are received in the control means 16. The fourth spur wheel 3' is disposed coaxially with the third spur wheel 3, which is in turn secured to the hollow shaft 5. The third spur wheel 3 engages the second printing cylinder spur wheel 1'. The intermediate spur wheels 2, 2', 3, 3' have a uniform outer diameter. The construction of the control means 16 is similar to the first example.

During printing operations, the changing device transfers driving force from the first printing cylinder to the second printing cylinder. This transfer is initiated via the printing cylinder spur wheel 1 and the first spur wheel 2' of the double wheel in engagement therewith. The drive is transmitted via the second spur wheel 2 of the double wheel in engagement with the first spur wheel 2'. The drive is transmitted via the second spur wheel 2 of the double wheel to the annular wheel 4' of the turning drum, and then via the fourth spur wheel 3' in conjunction with the solid shaft 6 to the second sun wheel 8, then via the planetary wheels 9, 10 and annular wheels 12, 13 to the first sun wheel 7. The first sun wheel 7 in turn drives the hollow shaft 5, driving the third spur wheel 3 which drives the spur wheel 1' of the second printing cylinder. As in the previous embodiment, the set of wheels is reinforced during printing, which also reduces possible clearance between teeth. To this end, the hollow shaft 5 and solid shaft 6 are connected by a clamping means 17. This connection is released during the phase shift of the turning drum.

The required phase shift of the turning drum is made by switching off the drive and connecting the positioning and braking means 15 as in the previous embodiment. The annular wheel 4' of the turning drum is adjusted as in the first example, by the pinion 14 engaging the externally toothed rim of the second annular wheel 13, which drives the second planetary wheel 10, the sun wheel 8, the solid shaft 6 and the fourth spur wheel 3', in turn driving the annular wheel 4'.

Figure 3:
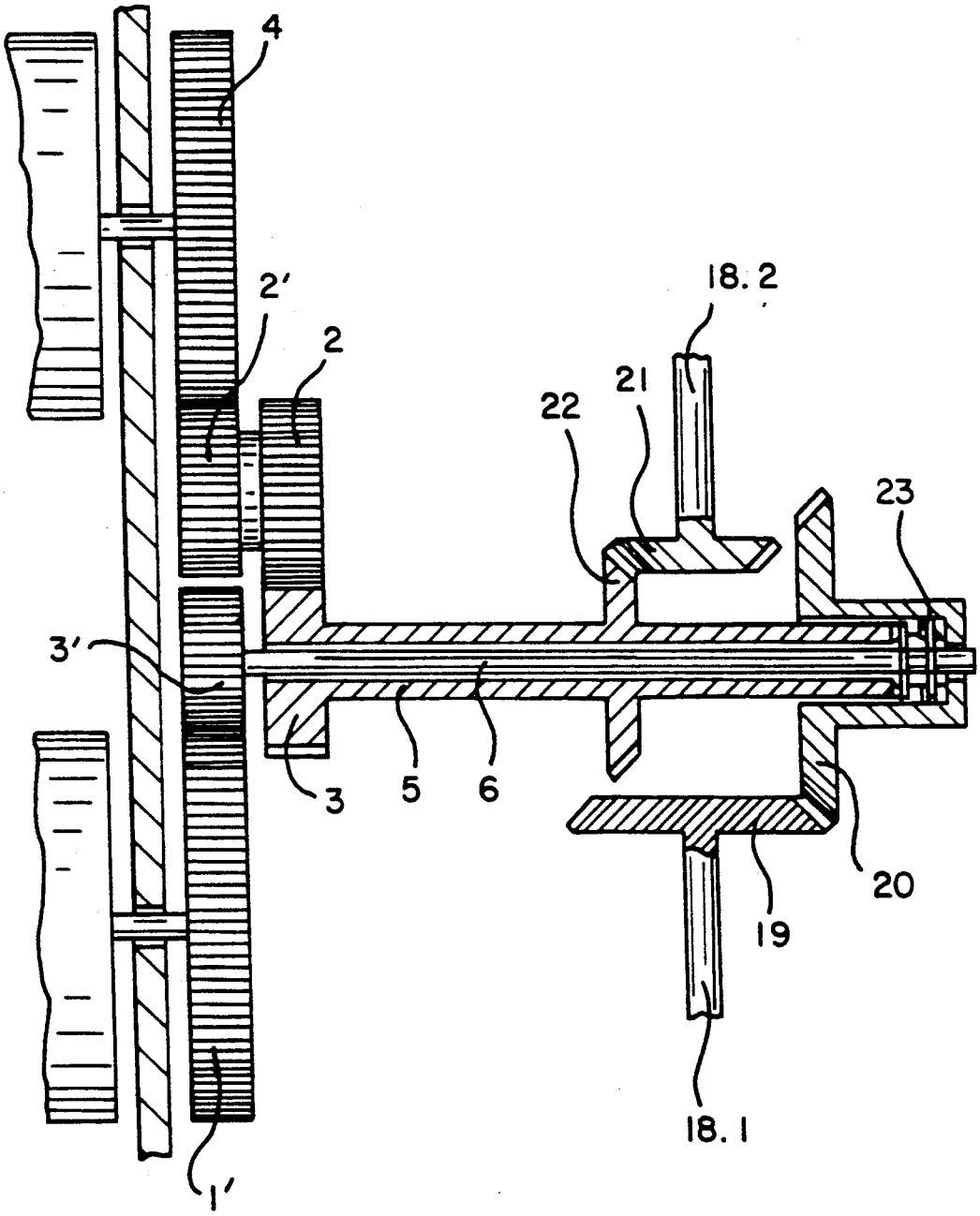
FIG. 3 is a sectional view of the changing device according to a third embodiment of the invention.

A third exemplary embodiment is shown in FIG. 3. Between the spur wheels 4, of the turning drum, and 1', of the printing cylinder, the set of wheels is formed via the intermediate spur wheels 2, 2' and 3, 3'. The first pair of intermediate spur wheels 2, 2, associated with the spur wheel 4 of the turning drum are in the form of a double wheel, only the first spur wheel 2' being in engagement with the spur wheel 4. The second spur wheel 2 engages the third spur wheel 3 disposed on the hollow shaft 5. The fourth spur wheel 3' is disposed coaxially with the third spur wheel 3 on the solid shaft 6, which is received in the hollow shaft 5. The fourth spur wheel 3' is paired with the printing cylinder spur wheel 1'. As in the first embodiment, the first and fourth spur wheels 2' and 3' have a smaller radius than the second and third spur wheels 2 and 3. All four have the same number of teeth, so that the first and fourth spur wheels 2' and 3' are out of engagement. A first bevel gear 20 is fixed to the solid shaft 6. A second bevel gear 19 is mounted on the drive shaft 18.1 and engages the first bevel gear 20 secured to the solid shaft 6. A third bevel gear 22 is fixed to the hollow shaft 5. A fourth bevel gear 21, diametrically opposite the second bevel gear 19, is disposed on the driven shaft 18.2 and engages the third bevel gear 22 secured to the hollow shaft 5. A coupling means 23 is disposed on the free end of the solid shaft 6 and the hollow shaft 5 to selectively connect the shafts together, either magnetically, pneumatically or hydraulically to make a phase shift between two printing units. The coupling means 23 take the place of the clamping means 17 in the previous embodiments.

The drive is initiated via the drive shaft 18.1, the second bevel gear 19 and the first bevel gear 20 in engagement. The first bevel gear 20 is mounted on the solid shaft 6, which is releasably coupled by coupling means 23 to the hollow shaft 5. From the hollow shaft 5, the drive is transmitted, on the one hand via the third bevel gear 22 in conjunction with the fourth bevel gear 21 via a driven shaft 18.2 to the downstream machine unit and on the other hand via shafts 5, 6 synchronized by the coupling means 23 to the turning drum and printing cylinder. The hollow shaft 5 drives third spur wheel 3 coupled to the double wheel 2, 2' on the spur wheel 4 of the turning drum. Further, the solid shaft 6 drives fourth spur wheel 3' coupled to the spur wheel 1' of the printing cylinder.

In order to shift the phase of the turning drum when necessary, the drive shaft 18.1 is switched off and the coupling 23 de-activated. The drive for phase-shifting the turning drum is transmitted to the spur wheel 4 via the driven shaft 18.2 and the fourth bevel gear 21 in conjunction with the third bevel gear 22, hollow shaft 5, third spur wheel 3 and intermediate spur wheels 2, 2'. After phase-shifting, the drive coming from the driven shaft 18.2 is switched off. The machine is driven via the drive shaft 18.1 or 18.2 after the coupling 23 has been engaged. The coupling 23 is currentless during operation of the machine. The bevel gears 20 and 22 are coupled by spring pressure so as to rotate in synchronism.

What is claimed is:

1. A device for changing between one-side printing and perfecting printing in sheet-fed rotary printing machines having a frame and in which the printing units are connected to a main drive by a closed train of wheels, comprising in combination:

a turning drum and a printing cylinder;

a turning drum spur wheel and a printing cylinder spur wheel, the turning drum spur wheel and the printing cylinder spur wheel lying in one plane and having the same width;

first and second intermediate spur wheels, the first and second spur wheels being in the form of a double wheel, the first spur wheel engaging the printing cylinder spur wheel;

third and fourth intermediate spur wheels, the third and fourth spur wheels being arranged coaxially, the third spur wheel engaging the second spur wheel and being fixed on a hollow shaft, the fourth spur wheel engaging the turning drum spur wheel and being fixed to a solid shaft coaxial with and disposed within the hollow shaft, the first and fourth spur wheels having a smaller radius than the second and third spur wheels, and the first, second, third and fourth spur wheels having the same number of teeth; and control means coupled to the output side of the solid shaft and the hollow shaft for selectively driving the solid and hollow shafts in unison or differentially with respect to one another.

2. The device for changing according to claim 1, wherein the control means comprises:

a housing fixed to the printing machine frame and into which the solid and hollow shafts project;

a first sun wheel fixed to the hollow shaft and a second sun wheel fixed to the solid shaft;

a rotatable web supported on the shafts;

first and second internally toothed annular wheels, the first annular wheel being fixed to the housing, the second annular wheel being carried on and rotatable with respect to the solid shaft, the second annular wheel having an outside-toothed rim;

first and second planetary wheels arranged parallel to one another and journalled for rotation on the rotatable web, the first and second planetary wheels being disposed respectively between the first and second sun wheels and the internally toothed first and second annular wheels; and positioning and braking means including a pinion engaging the outside-toothed rim of the second annular wheel for selectively rotating and stopping the second annular wheel.

3. The device for changing according to claim 2, including clamping means for detachably connecting the solid and hollow shafts together.

4. A device for changing between one-side printing and perfecting printing in sheet-fed rotary printing machines having a frame and in which the printing units are connected to a main drive by a closed train of wheels, comprising in combination:

a first and second printing cylinder and a turning drum;

a first printing cylinder spur wheel, a second printing cylinder spur wheel and a turning drum annular ring with internal teeth;

first and second intermediate spur wheels, the first and second spur wheels being in the form of a double wheel, the first spur wheel engaging the first printing cylinder spur wheel, and the second spur wheel engaging the internal teeth of the turning drum annular wheel;

third and fourth intermediate spur wheels, the third and fourth spur wheels being arranged coaxially, the third spur wheel engaging the second printing cylinder spur wheel and being fixed to a hollow shaft, the fourth spur wheel engaging the internal teeth of the turning drum annular ring and being fixed to a solid shaft coaxial with and disposed with the hollow shaft; and control means coupled to the output side of the solid shaft and the hollow shaft for selectively driving the solid and hollow shafts in unison or differentially with respect to one another.

5. The device for changing according to claim 4, wherein the control means comprises:

a housing fixed to the printing machine frame and into which the solid and hollow shafts project;

a first sun wheel fixed to the hollow shaft and a second sun wheel fixed to the solid shaft;

a rotatable web supported on the shafts;

first and second internally toothed annular wheels, the first annular wheel being fixed to the housing, the second annular wheel being carried on and rotatable with respect to the solid shaft, the second annular wheel having an outside-toothed rim;

first and second planetary wheels arranged parallel to one another and journalled for rotation on the rotatable web, the first and second planetary wheels being disposed respectively between the first and second sun wheels and the internally toothed first and second annular wheels; and positioning and braking means including a pinion engaging the outside-toothed rim of the second annular wheel for selectively rotating and stopping the second annular wheel.

6. The device for changing according to claim 5, including clamping means for detachably connecting the solid and hollow shafts together.

7. A device for changing between one-side printing and perfecting printing in sheet-fed rotary printing machines having a frame and in which the printing units are connected to a main drive by a closed train of wheels, comprising in combination:

a turning drum and a printing cylinder;

a turning drum spur wheel and a printing cylinder spur wheel, the turning drum spur wheel and the printing cylinder spur wheel lying in one plane and having the same width;

first and second intermediate spur wheels, the first and second spur wheels being in the form of a double wheel, the first spur wheel engaging the turning drum spur wheel;

third and fourth intermediate spur wheels, the third and fourth spur wheels being arranged coaxially, the third spur wheel engaging the second spur wheel and being fixed on a hollow shaft, the fourth spur wheel engaging the printing cylinder spur wheel and being fixed to a solid shaft coaxial with and disposed within the hollow shaft, the first and fourth spur wheels having a smaller radius than the second and third spur wheels, and all four spur wheels having the same number of teeth;

a first bevel gear fixed to the solid shaft;

a drive shaft including a second bevel gear engaging the first bevel gear;

a third bevel gear fixed on the hollow shaft;

an off-drive shaft including a fourth bevel gear engaging the third bevel gear, the fourth bevel gear being diametrically opposed to the second bevel gear; and coupling means attached to the free ends of the hollow shaft and solid shaft for selectively connecting the shafts together and disconnecting them from one another.

* * * * *